US005117726A

United States Patent [19]

Lisle et al.

[11] Patent Number: 5,117,726

[45] Date of Patent: Jun. 2, 1992

[54] METHOD AND APPARATUS FOR DYNAMIC MIDI SYNTHESIZER FILTER CONTROL

[75] Inventors: Ronald J. Lisle, Cedar Park; Bradley S. McDonald, Leander, both of Tex.

[73] Assignee: International Business Machines Corporation, Armonk, N.Y.

[21] Appl. No.: 608,112

[22] Filed: Nov. 1, 1990

[51] Int. Cl.[5] ..... G10H 1/12; G10H 7/10

[52] U.S. Cl. ..... 84/608; 84/623; 84/645; 84/DIG. 9

[58] Field of Search ..... 84/608, 622-625, 84/645, 661, 699, 700, 736, DIG. 9

[56] References Cited

U.S. PATENT DOCUMENTS 4,998,960 3/1991 Rose et al. ..... 84/622

*Primary Examiner*—Stanley J. Witkowski

*Attorney, Agent, or Firm*—Andrew J. Dillon

[57] ABSTRACT

A method and apparatus are disclosed for the dynamic control of a MIDI synthesizer filter. A digital filter controlled by a plurality of filter coefficients is preferably coupled to the output of an excitation signal source within a MIDI synthesizer. The excitation signal source is typically controlled by a MIDI data file comprising a sequential series of program control commands and matching note on and note off commands. A plurality of filter coefficient factors are stored in memory and periodically accessed in response to variations in the program control commands and matching note on and note off commands. The selected filter coefficient factors are then utilized to calculate appropriate filter coefficients so that the center frequency and filter Q of the digital filter may be dynamically and optimally controlled. In a preferred embodiment of the present invention a filter control circuit is also utilized to limit the output of the filter to a maximum level so that output stability is always maintained, independent of the initial conditions and filter coefficients of the filter.

8 Claims, 4 Drawing Sheets

METHOD AND APPARATUS FOR DYNAMIC MIDI SYNTHESIZER FILTER CONTROL

BACKGROUND OF THE INVENTION

1. Technical Field

The present invention relates in general to the field of digital music synthesizers and in particular to a method and apparatus for filtering the output of a digital music synthesizer. Still more particularly, the present invention relates to a method and apparatus for filtering the output of a digital music synthesizer with a dynamically controlled filter which is controllable under center frequency, sampling rate and filter Q by means of MIDI note numbers and program control commands contained within a MIDI data file.

2. Description of the Related Art

Musical synthesizers have been well known in the prior art for some time. Early analog synthesizers typically utilize an excitation waveform generator capable of generating sawtooth waveforms, triangle waveforms or square waves. The output frequency of this excitation waveform generator was controllable in response to a desired pitch and often a low frequency oscillator was connected to the excitation waveform generate to permit vibrato effects to be generated.

In such systems, the selectable output of the excitation waveform generator was then typically coupled to a filter and amplifier before being connected to an audio output device, such as a speaker.

Early music synthesizers often utilize a voltage-controlled filter. Analog filters are typically difficult to voltage control and were generally constructed utilizing L-C filters which were tuned by changing the reactive components, either the capacitor or the inductor. Later, with the widespread use of operational amplifiers and R-C active filters, the resistor was varied for fine tuning purposes and the capacitor was changed for different ranges.

The Q factor (or bandwidth in hertz) of a filter is another important feature of a filter and may be utilized to enhance the particular sound generated by an excitation waveform generator. For example, the acoustic differences between a horn sound and a string instrument sound may be emphasized by varying the bandwidth of a bandpass filter to permit more or less acoustic energy on either side of the center frequency to be amplified and coupled to a speaker.

Early researchers in the music synthesizer area discovered that the control of suitable filter and voltage controlled amplifiers may be expeditiously accomplished by means of a so-called "Attack-Decay-Sustain-Release" (ADSR) circuit. By selectively controlling the output of an ADSR circuit in each of its four segments an excitation signal may be shaped and filtered to approximate the sound of a desired musical instrument Of course, the wide variety of sounds and frequencies which are generated by a music synthesizer utilizing state-of-the-art technology renders the task of filtering the output substantially more difficult.

Current musical synthesizers typically utilize MIDI, the "Musical Instrument Digital Interface" which was established as a hardware and software specification which would make it possible to exchange information such as: musical notes; program changes; expression control; etc. between different musical instruments or other devices such as: sequencers; computers; lighting controllers; mixers; etc. This ability to transmit and receive data was originally conceived for live performances, although subsequent developments have had an enormous impact in recording studios, audio and video production, and composition environments.

The standard for the MIDI interface has been prepared and published as a joint effort between the MIDI Manufacturer's Association (MMA) and the Japan MIDI Standards Committee (JMSC). This standard is subject to change by agreement between JMSC and MMA and is currently published as the MIDI 1.0 Detailed Specification Document Version 4.1, January 1989.

The hardware portion of the MIDI interface operates at 31.25 KBAUD asynchronous, with a start bit, eight data bits and a stop bit. This makes a total of ten bits for a period of 320 microseconds per serial byte. The start bit is a logical zero and the stop bit is a logical on. Bytes are transmitted by sending the least significant bit first. Data bits are transmitted in the MIDI interface by utilizing a five milliamp current loop. A logical zero is represented by the current being turned on and a logical one is represented by the current being turned off. Rise times and fall times for this current loop shall be less than two microseconds. A five pin DIN connector is utilized to provide a connection for this current loop with only two pins being utilized to transmit the current loop signal.

Typically, an opto-isolator is utilized to provide isolation between devices which are coupled together utilizing a MIDI format. Communication utilized in the MIDI interface is achieved through multi-byte "messages" which consist of one status byte followed by one or two data bytes. There are certain exceptions to this rule. MIDI messages are sent over any of sixteen channels which may be utilized for a variety of performance information. There are five major types of MIDI messages: Channel Voice; Channel Mode; System Common; System Real-Time; and System Exclusive. A MIDI event is transmitted as a message and consists of one or more bytes.

A channel message in the MIDI system utilizes four bits in the status byte to address the message to one of sixteen MIDI channels and four bits to define the message. Channel messages are thereby intended for the receivers in a system whose channel number matches the channel number encoded in the status byte. An instrument may receive a MIDI message on more than one channel. The channel in which it receives its main instructions, such as which program number to be on and what mode to be in, is often referred to as its "Basic Channel." There are two basic types of channel messages, a Voice message and a Mode message. A Voice message is utilized to control an instrument's voices and Voice messages are typically sent over voice channels. A Mode message is utilized to define the instrument's response to Voice messages, Mode messages are generally sent over the instrument's Basic Channel.

System messages within the MIDI system may include Common messages, Real-time messages and Exclusive messages. Common messages are intended for all receivers in a system regardless of the channel that receiver is associated with. Real-time messages are utilized for synchronization and are intended for all clock based units in a system. Real-time messages contain status bytes only, and do not include data bytes. Real-time messages may be sent at any time, even between bytes of a message which has a different status. Exclusive messages may contain any number of data bytes and can be terminated either by an end of exclusive or any other status byte, with the exception of real-time messages. An end of exclusive should always be sent at the end of a System Exclusive message. System Exclusive messages always include a manufacturer's identification code. If a receiver does not recognize the identification code it will ignore the following data.

As those skilled in the art will appreciate upon reference to the foregoing, musical compositions may be encoded utilizing the MIDI standard and stored and/or transmitted utilizing substantially less data. The MIDI standard permits the transmittal of a serial listing of program status messages and channel messages, such as "note on" and "note off" and as consequence require substantially less digital data to encode than the straightforward digitization of an analog music signal.

In view of the foregoing, it should be apparent that it would be advantageous to provide a filter for utilization in a music synthesizer which is dynamically controllable by means of the data contained within a MIDI data stream. That is, a dynamically controllable filter which will automatically accommodate the particular acoustic characteristics of the sounds being generated by a MIDI synthesizer.

SUMMARY OF THE INVENTION

It is therefore an object of the present invention to provide an improved digital music synthesizer.

It is another object of the present invention to provide a method and apparatus for filtering the output of a digital music synthesizer.

It is yet another object of the present invention to provide a method and apparatus for filtering the output of a digital music synthesizer with a dynamically controlled filter which is controllable under center frequency, sampling rate and filter Q by means of MIDI note numbers and program control commands contained within a MIDI data file.

The foregoing objects are achieved as is now described. The method and apparatus of the present invention provides a digital filter which is dynamically controllable by a plurality of filter coefficients. The digital filter is preferably coupled to the output of an excitation signal source within a MIDI synthesizer. The excitation signal source is typically controlled by a MIDI data file comprising a sequential series of program control commands and matching note on and note off commands. A plurality of filter coefficient factors are stored in memory and periodically accessed in response to variations in the program control commands and matching note on and note off commands. The selected filter coefficient factors are then utilized to calculate appropriate filter coefficients so that the center frequency and filter Q of the digital filter may be dynamically and optimally controlled. In a preferred embodiment of the present invention a filter control circuit is also utilized to limit the output of the filter to a maximum level so that output stability is always maintained, independent of the initial conditions and filter coefficients of the filter.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with, the accompanying drawings, wherein:

DETAILED DESCRIPTION OF PREFERRED EMBODIMENT

Figure 1:
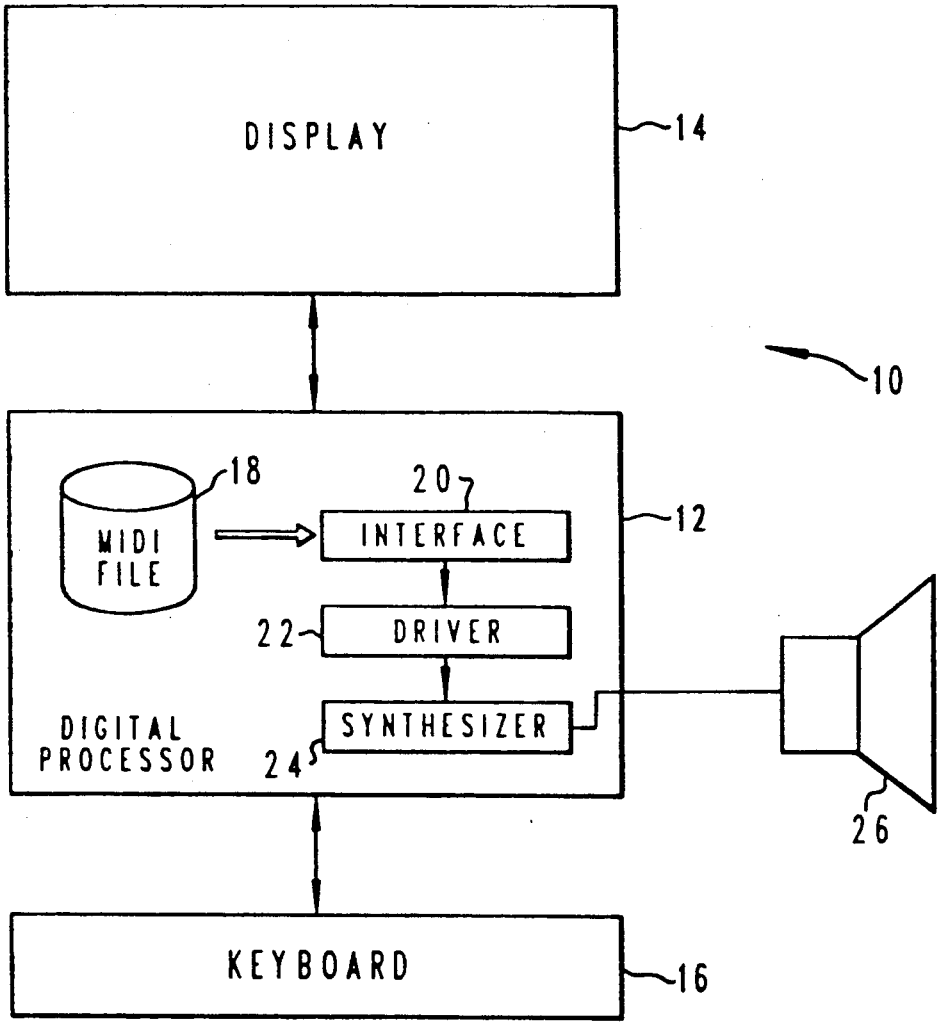
FIG. 1 is a block diagram depicting a computer system which may be utilized to implement a musical synthesizer in accordance with the method and apparatus of the present invention.

With reference now to the figures and in particular with reference to FIG. 1, there is depicted a block diagram which illustrates a computer system which may be utilized to implement a music synthesizer in accordance with the method and apparatus of the present invention. As is illustrated, a computer system 10 is depicted. Computer system 10 may be implemented utilizing any state-of-the-art digital computer system having a suitable digital signal processor disposed therein which is capable of implementing a MIDI synthesizer. For example, computer system 10 may be implemented utilizing an IBM PS/2 type computer which includes an IBM Audio Capture and Playback Adapter (ACPA).

Also included within computer system 10 is a display 14. Display 14 may be utilized to provide a visual indication of the progress of musical synthesis, in accordance with the method and apparatus of the present invention, and to permit a computer user to select a particular MIDI data file stored within computer system 10. Also coupled to computer system 10 is a computer keyboard 16. Computer keyboard 16 may be utilized, as those skilled in the art will appreciate, to initiate and terminate the operation of a music synthesizer which is implemented utilizing computer system 10 and to permit the user of computer system 10 to select specific MIDI data files stored within computer system 10.

Referring now to digital processor 12, the implementation of a MIDI synthesizer utilizing a digital signal processor within a computer system is illustrated. As depicted, data contained within a MIDI file 18 is coupled to an interface 20. Interface 20 is preferably implemented utilizing any suitable audio application program interface which permits the accessing of MIDI protocol files and the coupling of those files to an appropriate device driver. Device driver 22 is also preferably implemented in software and serves to process the MIDI file data in a manner which permits that data to be utilized to create music. Thereafter, the output of driver 22 is coupled to a synthesizer 24. Synthesizer 24 is preferably a subtractive synthesizer which is implemented utilizing a suitable digital signal processor, such as the Texas Instruments TMS 320C25 digital signal processor which is contained within the IBM Audio Capture and Playback Adapter (ACPA). Thereafter, the output of synthesizer 24 may be coupled to an audio output device, such as speaker 26.

Figure 2:
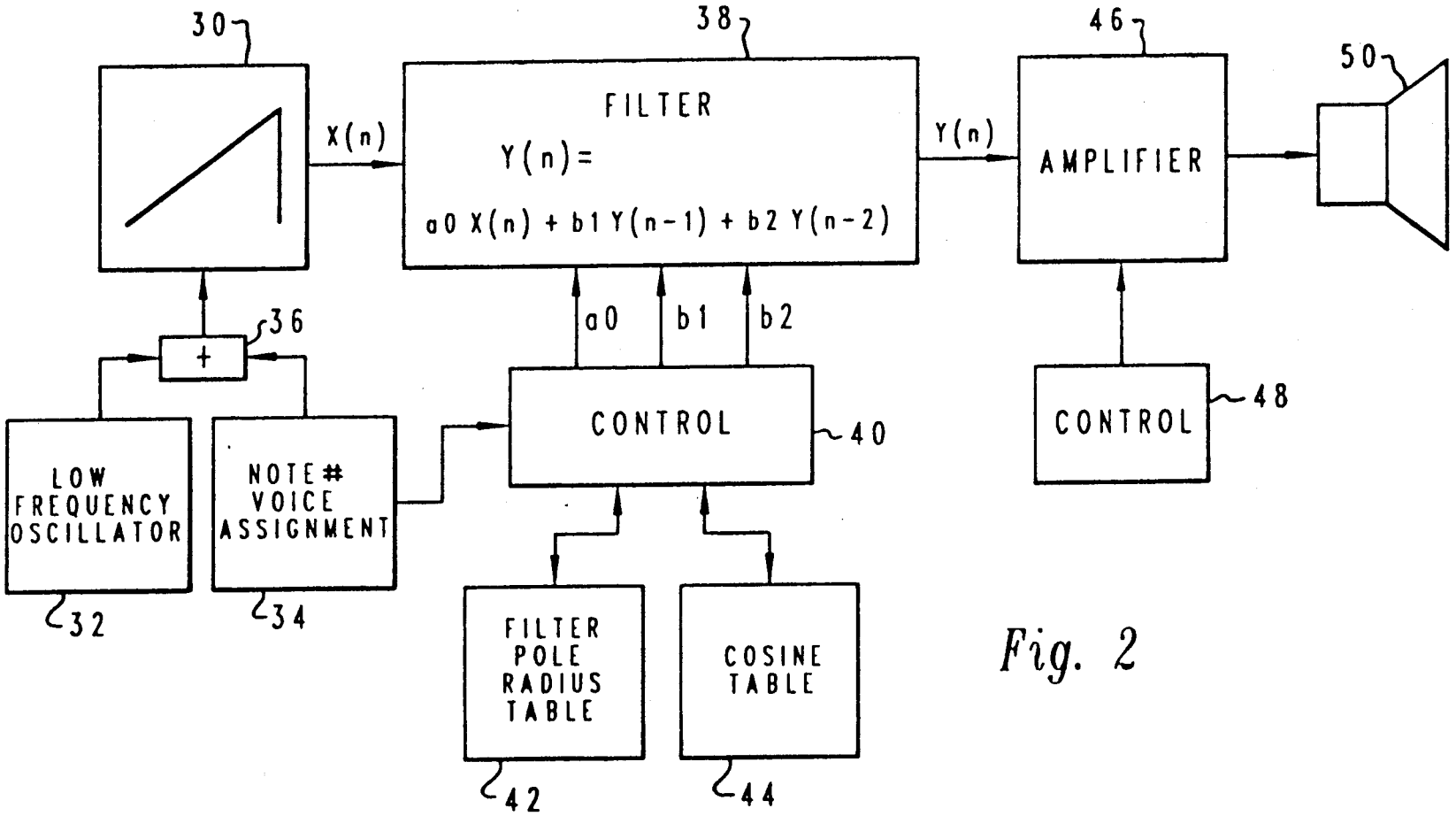
FIG. 2 is a more detailed block diagram of a synthesizer apparatus which may be utilized to implement the method of the present invention.

Thus, in the manner illustrated in FIG. 2, a modern digital computer may be utilized to emulate a MIDI synthesizer by utilizing a special purpose digital signal processor to access MIDI files stored within memory within computer system 10 to create or recreate musical compositions which have been stored as digital MIDI files.

Referring now to FIG. 2, there is depicted a more detailed block diagram of a synthesizer apparatus which may be utilized to implement the method of the present invention. Of course, those skilled in the art will appreciate that the synthesizer depicted within FIG. 2, while shown as individual block sections, may be implemented utilizing a single special purpose digital signal processor, such as the Texas Instruments TMS 320C25, which is contained within the IBM Audio Capture and Playback Adapter (ACPA) card.

As illustrated in FIG. 2, an excitation signal source 30 is depicted. Excitation signal source 30 is preferably a sawtooth wave generator which may be simply and efficiently implemented in a digital circuit by the initiation of a signal and the incrementing of that signal by a constant value while storing the previous value. The output of excitation signal source 30 is then coupled to digital filter 38. Digital filter 38 represents an important feature of the present invention in that it is a dynamically controllable filter which, in a manner which will be explained in greater detail herein, is controllable by means of the information contained within a MIDI data file dynamically during the creation of synthesized music utilizing that file.

Next, the output of digital filter 38 is coupled to amplifier 46 and then to audio output device 50. In the depicted embodiment of the present invention, audio output device 50 preferably comprises an audio speaker or pair of speakers in the case of stereo music. Thus, in the manner depicted in FIG. 2, digitally synthesized music may be created and coupled to audio output device 50.

Referring again to excitation signal source 30, it may be seen that this device is controlled by two separate inputs. Note number and voice assignment generator 34 is preferably utilized to control the pitch or fundamental frequency from excitation signal source 30 in accordance with a so-called "note number" which may be read from a Musical Instrument Digital Interface (MIDI) file or generated by an electronic musical keyboard. Further, voice assignment commands may also be utilized to control the output of excitation signal source 30 in a similar manner.

The output of excitation signal source 30 may be modified, in a manner well known in the art, to optimize the synthesis of a particular musical instrument by identifying that musical instrument utilizing a voice assignment command contained within a MIDI data file or generated by an electronic musical keyboard. Additionally, low frequency oscillator 32 is also provided and mixed with the output of note number and voice assignment generator 38, in additive mixer 36, to permit low frequency variations in the pitch of the output signal of excitation signal source 30, so that vibrato effects may be accomplished.

Next, it may be seen that the output of excitation signal source 30 [x(n)] is coupled to digital filter 38. Digital filter 38 is preferably a second order Infinite Impulse Response (IIR) digital filter which exhibits a transfer function which may be expressed in the time domain as:

$$Y(n)=a0*x(n)+b1*Y(n-1)+b2*Y(n-2). \quad (1)$$

Thus, the filter coefficients a0, b1, b2 may be dynamically updated and provided by control circuit 40.

In a manner which will be explained in greater detail herein, control circuit 40 derives these filter coefficients by parsing various commands from the MIDI data stream, including note numbers and voice assignments, and then utilizing these factors to access values in filter pole radius table 42 and the center frequency cosine, in cosine table 44. In a preferred embodiment of the present invention, these filter coefficients are updated approximately three hundred times per second to permit digital filter 38 to dynamically track and optimally filter the output of excitation signal generator 30.

Thereafter, the output of digital filter 38 is coupled to amplifier 46. Amplifier 46 is preferably controlled by control circuit 48. Control circuit 48 may be implemented utilizing any suitable amplifier control circuit such as an Attack-Decay-Sustain-Release (ADSR) circuit which is well known in the art. Finally, as discussed above, the output of amplifier 46 is coupled to audio output device 50.

Figure 3:
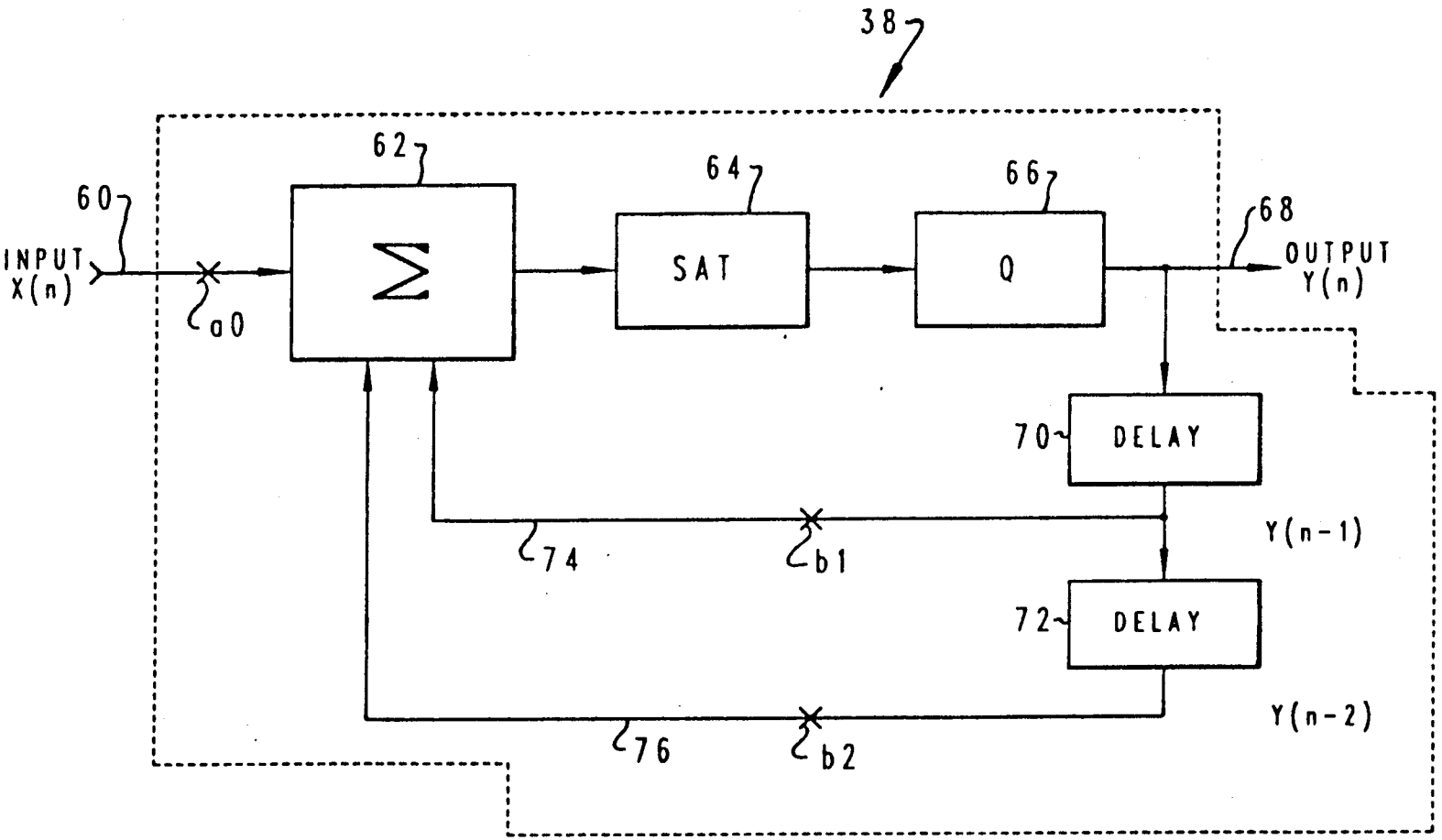
FIG. 3 is a more detailed block diagram of the digital filter of FIG. 2 which may be utilized to implement the method of the present invention.

With reference now to FIG. 3, there is depicted a more detailed block diagram of digital filter 38 of FIG. 2. As is illustrated, an input signal is coupled to digital filter 38 at point 60 and multiplied by a gain factor a0 before being coupled to summation circuit 62. Summation circuit 62 serves to sum the input signal, which has been multiplied by an appropriate gain factor, with two previous values for the output signal, in a manner which will be illustrated in greater detail herein.

Next, the output of summation circuit 62 is coupled to saturation circuit 64. In accordance with an important feature of the present invention, saturation circuit 64 is utilized to limit the output of summation circuit 62 for purposes of enhancing stability. The depicted embodiment of the present invention limits the calculation of the accumulator within summation circuit 62 to a maximum positive or negative number and thereby allows time variant digital filter 38 of the present invention to maintain the integrity of an output, despite any initial value settings for the previous outputs of digital filter 38.

Those skilled in the art will appreciate that these initial values may be initialized at any level and may drive the output of summation circuit 62 out of range. Saturation circuit 64 may be utilized to prevent this from occurring in a manner which is analogous to a voltage rail in an analog implementation of an amplifier circuit.

The "clipping" of an acoustic waveform often causes odd harmonic distortion which is very harsh sounding; however, the duration of time that this distortion occurs tracks the rate of change of digital filter 38. For example, when digital filter 38 is changed slowly there is very little distortion. When the rate of change of digital filter 38 is rapid, there is significant distortion but there is little perception of distortion because the distortion is masked by the dynamics of the music being created.

In this manner, the output of digital filter 38 may be fully controlled and will maintain unconditional stability while generating perceptually negligible non-linearities in the output circuit.

Next, QUAN circuit 66 is utilized to quantize the output of saturation circuit 64 from a 32 bit value to a 16 bit value. Thereafter, the output signal is coupled out of digital filter 38 at point 68.

Concurrently, the output signal of digital filter 38 is also coupled to delay circuit 70 and delay circuit 72 in a serial manner. The outputs of each delay circuit, are then scaled by the gain factors b1 and b2 respectively, and coupled via lines 74 and 76 to summation circuit 62. Those skilled in the art will, upon reference to FIG. 3, appreciate that this is a standard block diagram for a direct form second order digital filter which exhibits, in the time domain, the transfer function set forth above in equation 1.

Figure 4:
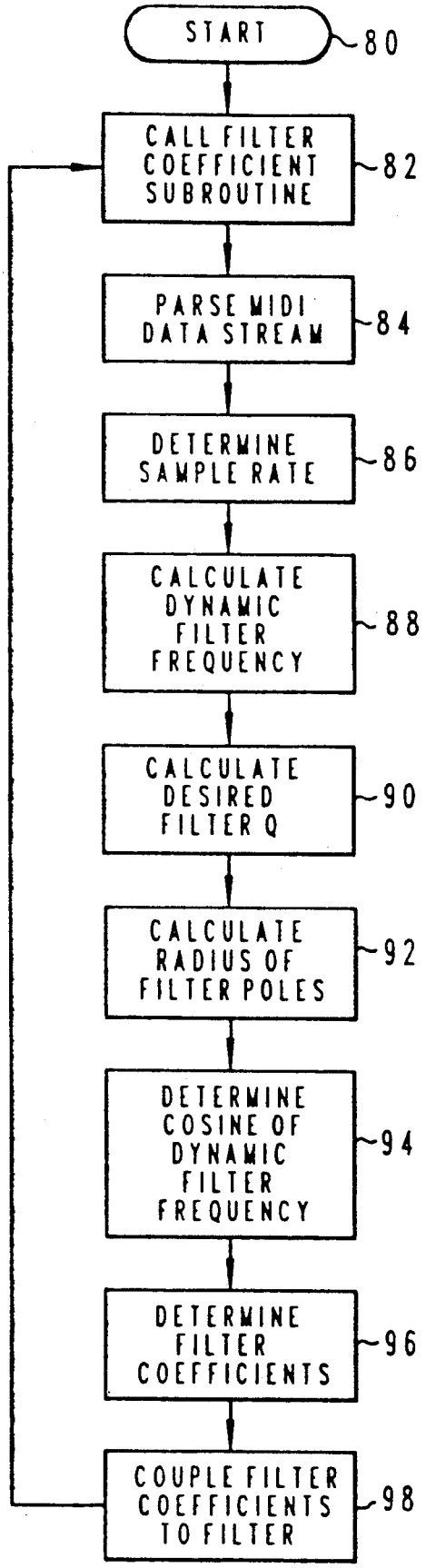
FIG. 4 is a high level flow chart illustrating the method of the present invention.

Finally, with reference to FIG. 4, there is depicted a high level flow chart which illustrates the method of the present invention. As depicted, the process begins at block 80 and thereafter passes to block 82 which illustrates the calling of the filter coefficient subroutine. In the depicted embodiment of the present invention, the dynamically controllable filter coefficients of digital filter 38 are recalculated three hundred times per second in order to optimally control the performance of digital filter 38 for the synthesized music which is created utilizing a MIDI synthesizer.

Prior to discussing the process of FIG. 4, it will be illustrative to review the mathematical basis of the filter of FIG. 3. The first step in defining the structure of digital filter 38 requires a determination of the radius of the filter poles and the cosine of Φ, the angle defined by each of the filter poles. In order to calculate the radius of the filter pole, we must first define the filter Q. Those skilled in the art will appreciate that filter Q may be expressed as:

$$Q = \frac{W_c}{W_{hi} - W_{low}} \tag{2}$$

Where $W_c$ equals the center frequency of interest, $W_{hi}$ equals the minus three db point on the high side of the center frequency of interest and $W_{low}$ equals the minimum three db point on the low side of the frequency of interest.

In a sample data system such as that disclosed herein, the center frequency of interest may be defined as:

$$W_c = \frac{\Phi W_s}{2\pi} \tag{3}$$

Where $W_s$ is the sample data rate for the system.

Next, θ, the angle defined by the minus three db points may be expressed as follows:

$$\theta = \pi W_c/(W_s Q) \tag{4}$$

Recognizing that the distance from a pole within a unit circle at a radius r to the perimeter of that circle is simply (1−r) and utilizing the Law of Cosines, the following equation may be obtained:

$$\left[\frac{1-r}{.707}\right] = r^2 + 1 - 2r\mathrm{Cos}\left[\frac{\pi * W_c}{W_s * Q}\right] \tag{5}$$

Equation (5) gives a relationship between the filter value r and the control variables $W_c$, $W_s$ and Q. In order to enable this equality to be executed on a digital signal processor platform, a relationship must be established between equation (5) and MIDI note numbers.

What may be observed from equation (5) is that the appropriate value of r may be selected by utilizing the argument of the cosine and a look up table. However, this computation is difficult to perform on a digital signal processor platform in real time, especially when the $W_c$ are expressed in MIDI note number values. However, the relationship between MIDI note numbers and $W_c$ may be expressed as shown below:

$$MIDI\ \text{note}\ \# = 60 + \frac{\log\left[\frac{W_c}{\text{Middle } C}\right]}{\log[2^{(1/12)}]} \tag{6}$$

Since we are interested in relative performance, the cosine argument of equation (6) may be represented by the following:

$$\left[\frac{\pi W_c}{W_s Q}\right] = \left[\frac{C(W_c/W_{cref})}{(W_s/W_{sref})(Q/Q_{ref})}\right] \tag{7}$$

Where C is a constant. By taking the log of equation (7), we obtain equation (8):

$$\log\left[\frac{\pi W_c}{W_s Q}\right] = \log C + \log(W_c/W_{cref}) - \log(W_s/W_{sref}) - \log(Q/Q_{ref}) \tag{8}$$

Further, equation (8) may be divided by the following factor:

$$\log[2^{(1/12)}]$$

In order to obtain the desired number of log steps. Thus, equation (8), having been divided by the factor listed in equation (9) may now be expressed as the following:

$$N = N_{MIDI\ note} - N_{ws} - N_Q + C_1 \tag{9}$$

Where N is the log argument of the cosine term. $N_{MIDI\ note}$ is the center frequency desired for the filter expressed in MIDI note numbers. $N_{ws}$ is the sampling frequency expressed in note number, providing twelve log steps in frequency per octave, and $N_Q$ is the filter Q expressed in note number context providing twelve log steps in Q per doubling of Q.

Next, the value for r may be determined by accessing a table created utilizing equation (5) with the value N, the log argument of the cosine term. This table preferably stored within filter pole radius table 42 (see FIG. 2). The cosine of the filter frequency desired may also be determined by accessing a cosine table created in accordance with equation (11):

$$\mathrm{COS}(N_{MIDI\ note}) = \mathrm{COS}(2 * \pi * (F_{MIDDLEC}/60) * N_{MIDI\ NOTE}) \tag{11}$$

The values for each cosine are then preferably stored in cosine table 44 (see FIG 2). Thereafter, the necessary coefficients to optimize digital filter 38 for the current acoustic output of excitation signal generator 30 may be calculated in accordance with the following equations:

$$b2 = r^2 \tag{12}$$

$$b1 = -r\mathrm{COS}(N_{MIDInote}) \tag{13}$$

$$a = (1-r) * [Sqrt[1 + r^2 - 2(\mathrm{COS}(N_{MIDInote})) * b1 + 2r]] \tag{14}$$

Referring again to FIG. 4, the filter coefficient calculation subroutine begins in block 84 with the parsing of the MIDI data stream. This step permits the MIDI data stream to be examined to determine desired filter ADSR parameters, low frequency oscillator parameters, velocity parameters, and desired Q and Q parameters. Next, block 86 illustrates the determining of the sample rate of the output of excitation signal generator 30. Those skilled in the art will appreciate that it is necessary for digital filter 38 to operate at the same sample rate as excitation signal generator 30; however, by utilizing a dynamic controllable filter created in accordance with the method and apparatus of the present invention, it will be possible to vary the sample rate utilized by the filter to accommodate variations in the sample rate of the excitation signal.

Next, block 88 illustrates the calculation of the dynamic filter frequency in the manner described above. Thereafter, block 90 illustrates the calculation of the desired filter Q. As discussed above, the desired filter Q for digital filter 38 may be varied in response to the type of voice or instrument which is being synthesized. Of course, filter Q may be a fixed value or may vary with time by utilizing a low frequency oscillator to create various special effects.

Next, block 92 illustrates the calculation of the radius of the filter poles for digital filter 38. This is accomplished by accessing a table created utilizing equation (5) with the log argument N of equation (9). The cosine of the dynamic filter frequency is then determined, by utilizing a table created in accordance with equation (11) as illustrated in block 94.

Finally, the filter coefficients a0, b1 and b2 are then determined, as illustrated in block 96, by utilizing equations (12), (13) and (14). Finally, these filter coefficients are coupled to digital filter 38, as depicted in block 98 and the process returns to block 82 to iterate and recalculate the filter coefficients three hundred times per second.

Those skilled in the art upon reference to the foregoing that the Applicants in the present application have provided a dynamically controllable digital filter for utilization in a MIDI data file controlled music synthesizer which permits the coefficients of the digital filter to be dynamically and optimally controlled by the expedient of utilizing commands and messages contained within the MIDI data file. In this manner, digital filter 38 (see FIG. 2) may be accurately and automatically controlled in real time to optimally filter the output of excitation signal generator 30 to create the desired synthesizer acoustic sounds.

While the invention has been particularly shown and described with reference to a preferred embodiment, it will be understood by those skilled in the art that various changes in form and detail may be made therein without departing from the spirit and scope of the invention.

We claim:

1. A digital filter for utilization in a digital music synthesizer having an excitation signal source which is controlled by a MIDI data file including a sequential series of program control commands and matching note on and note off commands, said filter comprising:

bandpass filter mans having a selectable center frequency; and control means coupled to said bandpass filter means and said MIDI data file for periodically altering said selectable center frequency in response to variations of said matching note on and note off commands.

2. The digital filter for utilization in a digital musical synthesizer according to claim 1, wherein said bandpass filter means includes means for varying the Q of said bandpass filter.

3. The digital filter for utilization in a digital musical synthesizer according to claim 2, wherein said control means periodically alters the Q of said bandpass filter in response to variations of said program control commands within said MIDI data file.

4. The digital filter for utilization in a digital musical synthesizer according to claim 1, wherein said bandpass filter means comprises a second order digital filter controlled by a plurality of filter coefficients.

5. The digital filter for utilization in a digital musical synthesizer according to claim 4, wherein said control means includes memory means for storing a plurality of filter coefficient factors and means for accessing selected ones of said filter coefficient factors in response to variations of said matching note on and note off commands.

6. The digital filter for utilization in a digital musical synthesizer according to claim 4, wherein said bandpass filter includes means for limiting an output of said bandpass filter to a maximum level wherein said bandpass filter demonstrates unconditional stability.

7. A method for filtering the output of a digital music synthesizer having an excitation signal source which is controlled by a MIDI data file including a sequential series of program control commands and matching note on and note off commands, said method comprising the steps of:

providing a bandpass filter having a selectable center frequency controlled by a plurality of filter coefficients;

storing a plurality of filter coefficient factors in memory;

periodically accessing said selected ones of said filter coefficient factors in response to variations in said matching note on and note off commands;

calculating said plurality of filter coefficients from said filter coefficient factors; and controlling said bandpass filter utilizing said calculated plurality of filter coefficients wherein said center frequency may be selected.

8. The method for filtering the output of a digital musical synthesizer according to claim 7, further including the step of limiting the output of said bandpass filter to a preselected maximum value wherein said bandpass filter demonstrates unconditional stability.

* * * * *